United States Patent [19]

Ingalls

[11] Patent Number: 4,779,896

[45] Date of Patent: Oct. 25, 1988

[54] SKI POLE

[76] Inventor: James W. Ingalls, 2728 Versailles Ct., Ponte Vedra Beach, Fla. 32082

[21] Appl. No.: 78,207

[22] Filed: Jul. 27, 1987

[51] Int. Cl.[4] ..... A63C 11/22

[52] U.S. Cl. ..... 280/821; 280/822

[58] Field of Search ..... 280/819, 822, 823, 821; 403/322, 325; 135/65, 81, 114

[56] References Cited

U.S. PATENT DOCUMENTS

| | | | |
|---|---|---|---|
| 3,093,402 | 6/1963 | Sisson | 135/65 |
| 3,378,272 | 4/1968 | Lewis | 280/822 |
| 3,982,747 | 9/1976 | Schweinsberg | 280/822 |
| 4,453,449 | 6/1984 | Hollman | 403/322 |

FOREIGN PATENT DOCUMENTS

| | | | |
|---|---|---|---|
| 2352600 | 4/1975 | Fed. Rep. of Germany | 280/822 |
| 2267808 | 11/1975 | France | 280/823 |

*Primary Examiner*—David M. Mitchell

*Assistant Examiner*—Brian L. Johnson

*Attorney, Agent, or Firm*—Arthur G. Yeager

[57] ABSTRACT

A control rod having a wrist strap fastened thereon is connected to a ski pole and its handle. The control rod is positively releasably locked to the pole. The releasable lock comprises a resilient latch which engages the control rod via a circumferential channel therein and which is moved laterally outward when the rod is depressed. Downward movement of the control rod against a helical biasing spring causes a tubular collar to engage and force the latch outward into a vertical slot in a tubular member. The lock preferably has opposed latches that are integral upstanding members of a cylindrical member disposed within the tubular member. The spring, housed within the cylindrical member, causes the control rod to move upward placing the channel above the latches before the latches return to their normal position so that the rod and strap are removed from the ski pole and its handle.

20 Claims, 2 Drawing Sheets

SKI POLE

BACKGROUND OF THE INVENTION

1. Field of the Invention

The present invention relates to ski poles and in particular to ski poles in which quick release of the wrist straps and positive connection are provided.

2. Prior Art

For safety reasons, skiers are required to remove their ski poles from their wrists when boarding chair lifts and other systems used to transport a skier to a particular point on a ski slope. In addition, skiers often desire a quick method for removing the wrist straps after a fall or in the event the pole becomes entangled with tree limbs and the like. Rapid removal of the wrist strap is made difficult because a skier is usually wearing thick gloves to protect the hands from the cold.

A number of ski poles having wrist strap release mechanisms are known in the prior art. The principal difficulty with wrist strap release devices of the prior art is the lack of a positive locking means associated with the release mechanism. The prior approach usually involves a ball that is held by a spring which moves when sufficient force is applied to the handle. See, for example, U.S. Pat. Nos. 3,982,747; 3,797,845; 3,378,272; and 2,946,600. These devices are unacceptable for several reasons. First, the normal approach is to use leaf springs which can become bent or otherwise distorted. Second, forces sufficient to release the wrist strap may easily be attained during normal skiing causing a release of the strap and loss of the ski pole. Third, the devices may collect ice or other debris and thus may not be properly engaged. A positive locking feature in accord with this invention, substantially overcomes all of these aforementioned problems. Also, the improved device is not easily damaged and, has extended life beyond leaf springs engaging a ball or the like. Accidental or premature release is highly unlikely with the positive locking feature and the user is alerted to any problem associated with ice or debris interference with the releasing mechanism by providing a distinct "feel" when it snaps into the locked position.

SUMMARY OF THE INVENTION

In one aspect according to this invention, the improved ski pole, which is fabricated with a hollow tubular upper end portion, a wrist strap, and a handle attached to the upper end portion, and is provided with a selective connecting means for attaching the wrist strap to the ski pole, which includes an elongated control rod having a lower end part and an upper end part extending above the handle and secured to the wrist strap. A positive locking means located within the ski pole releasably secures the rod to the ski pole. The control rod is movably engageable with the thumb of a hand of a skier to cause the locking means to release the rod for removal of the rod from the ski pole with the strap about a wrist of a skier.

In other aspects the positive locking means comprises at least one resilient latch for releasably engaging the control rod and means for moving the latch laterally outward for releasing the control rod in response to downward pressure on the rod. The means for moving the latch laterally outward comprises a slidingly movable tubular collar having an upper surface part and a lower surface part adapted to rest upon the upper surface of the latch. The control rod includes a downwardly disposed shoulder resting upon the upper surface part of the collar for forcing the collar downwardly against the upper surface of the latch when the control rod is pushed downwardly so that the collar causes the latch to move laterally for releasing the control rod. The positive locking means includes a cylindrical member disposed below and connected to the latch and slidingly fitted within the pole against its interior wall thereof, and stop means for limiting the vertical movement of the latch. A tubular member is affixed to the handle and has a shoulder. The stop means includes a tubular collar resting upon the latch and has an upper surface vertically engaged by the shoulder of the tubular member to limit the upward movement thereof.

Further aspects are directed to the tubular member being rigidly affixed to the handle and being disposed within the pole, and having a vertical slot. The vertical slot is laterally aligned with the latch for permitting the latch to move outwardly thereinto when the control rod is forced downwardly. The cylindrical member is disposed within the tubular member and has at least one tab protruding laterally therefrom. The tubular member includes at least one slot for nestingly receiving the tab when the cylindrical member is placed therein. Also, a biasing means, preferably a helical compression spring, exerts an upward force against the control rod. The handle has a lower end portion and an upper end portion including an interior threaded recess. The tubular member includes an upper exterior threaded portion for threadedly engaging the recess. The handle is frictionally engageable about a hollow tubular upper end portion of a ski pole with the tubular member being disposed within the hollow portion thereof.

Additional aspects in accord with this invention relate to the ski pole including an elongated handle having a lower end portion and an upper end portion with an interior threaded recess therein, an elongated wrist strap detachably connected to the handle and an elongated cylindrical hollow pole having an upper portion and a lower portion. An elongated tubular member has a lower portion and an upper exterior threaded portion for threadably engaging the recess. The lower portion of the tubular member is provided with at least one elongated vertical slot and is slidingly disposed within the pole upper portion with its upper portion extending above the pole. A cylindrical member is disposed within the tubular member and has at least one resilient latch, the latch having an upper end in latching position disposed inwardly. Connecting means secure the cylindrical member within the tubular member with the resilient latch laterally aligned with the vertical slot. An elongated cylindrical control rod has an upper end portion attached to the strap and the lower end portion has a circumferential channel for releasable engagement by the latch when positioned within the tubular member. A tubular collar is slidingly disposed within the tubular member and engageable with the latch. A spring biasing means is disposed within the tubular member to apply an upward force to the control rod. The latch is selectively released from the channel by applying a downward pressure on the control rod causing the collar to force the latch outwardly into the slot for releasing the control rod and permitting the biasing means to move the control rod to dispose the channel thereof to be above the latch before the latch returns to its normal inwardly latching position.

BRIEF DESCRIPTION OF THE DRAWINGS

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

DETAILED DESCRIPTION OF THE DRAWINGS

Figure 1:
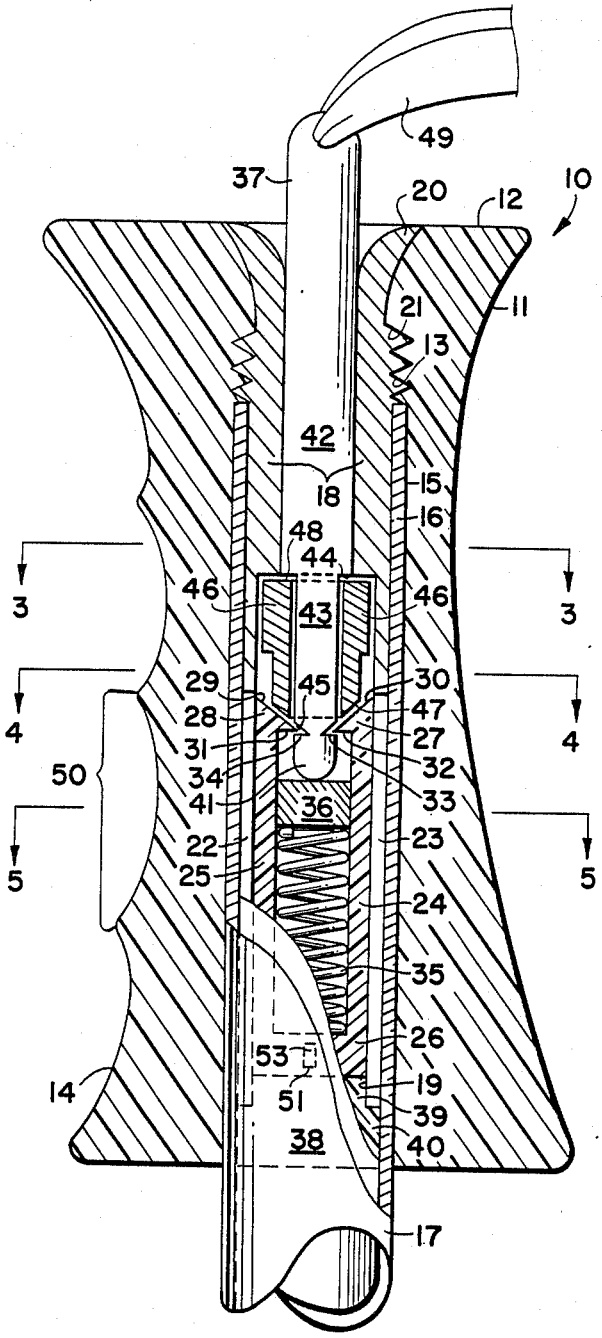
FIG. 1 is a side elevational view, partly in cross section of the upper portion of the ski pole in accord with the present invention with the wrist strap and rod positively connected to the pole and its handle.

Referring now to FIG. 1, the upper portion of the ski pole in accordance with the present invention is generally depicted by the numeral 10. An elongated stiff rubber handle 11 has an upper portion 12 with an interior threaded recess 13 and a lower portion 14 adapted to tightly fit about the upper end portion 16 of an elongated hollow pole 15 which has a lower end portion 17. An elongated tubular member 18 includes a lower portion 19 within the pole 15 and an upper portion 20 which extends above the pole upper end portion 16 and has an external threaded portion 21 threadedly engaged with internally threaded recess 13 of handle 11.

The tubular member 18 includes two oppositely disposed vertical slots 22, 23 sized and laterally oppositely aligned to provide space for the outward movement of two oppositely disposed upstanding resilient latches 24, 25 formed integral with a cylindrical base member 26 that is disposed within the tubular member 18 in the lower portion 19 thereof. Each latch 24 and 25 has an upper part 27 and 28 respectively shaped to have an inwardly disposed tapered upper face 29, 30 respectively and a substantially horizontal lower face 31, 32 respectively. Faces 29 and 31 and 30 and 32 respectively form an inward edge 33 and 34 respectively which fit within a cooperating channel 45, as hereinafter more fully described.

A helical spring 35 with an upper disc or pad 36 is used to bias upwardly the control rod 37. The lower end of spring 35 rests against the upper inner surface of the bottom **26*a* of the cylindrical member 26. Member 26 rests upon a circular plug 38 which has a reduced upper portion 39 and a lower portion 40 of greater diameter. Upper plug portion 39 fits within tubular member 18 and is affixed thereto with lower portion 40 being positioned closely adjacent the interior walls of pole 15 to secure cylindrical member 26 and tubular member 18 in its proper position within the pole 15. The upper end of spring 35 and disc 36 engages against the lower end 41 of control rod 37 and as shown in FIG. 1 is biased upwardly into its locked condition with latch ends 27, 28 engaged within channel 45**.

The elongated control rod 37 having a cylindrical upper portion 42 and a lower portion 43 of smaller diameter forming a downwardly disposed shoulder 44. The lower portion of rod 37 has a circumferential channel 45 shaped to substantially match or conform to the upper ends 27, 28 of latches 24, 25 so that the ends 27, 28 may fit therein regardless of the rotative orientation of the rod 37. Tubular collar 46 fits around the lower end portion 43 of rod 37 and includes a lower face 47 shaped to substantially match the upper faces 29, 30 of latches 24, 25. The upper face 48 of collar 46 is engageable by the shoulder 44 when rod 37 is depressed.

Figure 2:
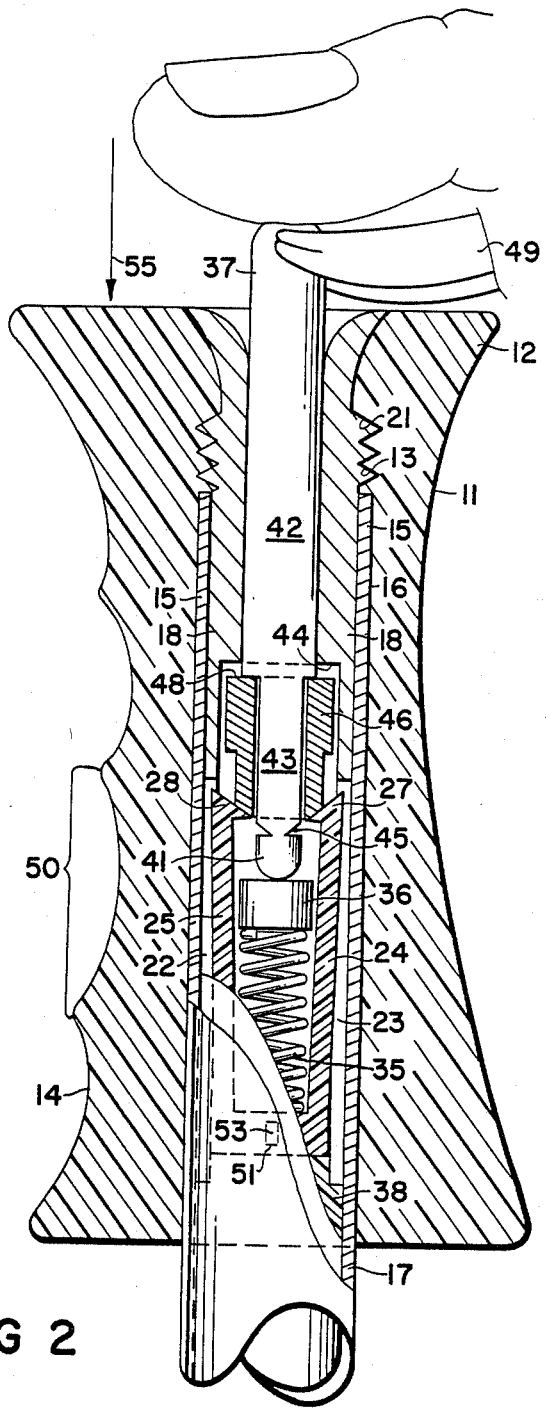
FIG. 2 is a view substantially identical to FIG. 1 showing the wrist strap and rod being initially released by the positive locking means in accord with the invention.
Figure 3:
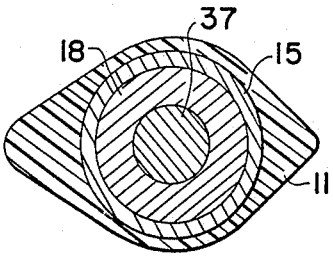
FIG. 3 is a cross section of the upper portion of the ski pole taken along line 3—3 of FIG. 1.

When the control rod 37 is initially pushed downward by the user's thumb in the direction of arrow 55, as shown in FIG. 2, shoulder 44 engages upper face 48 of collar 46 and forces the collar 46 downward against the upper faces 29, 30 of latches 24, 25. The inwardly tapered or slanted upper faces 29, 30 of the latch 24, 25 results in an outwardly directed force being applied to move the latches 24, 25 into the vertical slots 23, 22 respectively. Upon more downward depression of rod 37, the edges 33, 34 of the respective latches 24, 25 move laterally outward away from and clear channel 43, whereupon the compressed spring 35 will force the control rod 37 upwardly more rapidly to clear channel 45 away from and above the latches 24, 25. The resiliency of the latches 24, 25 is such that once they move laterally they will not return to the normal position until after control rod 37 has been released upwardly by the action of compression spring 35. If found to be desirable, another spring could be positioned between surface 48 and shoulder 44 to deter reaction of the latches 24, 25 until after full clearance of the lower end 41 of the control rod 37.

In practice, control rod 37 is pushed downward and immediately released upon the engagement of the latches 24, 25 into channel 45. Wrist strap 49 is secured to the upper end of rod 37 and is thus detached from the ski pole 10 by the removal of control rod 37 from the tubular member 18. Tubular collar 46 has an upper portion with greater diameter than its lower portion.

Figure 4:
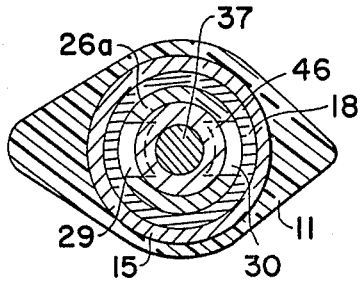
FIG. 4 is a cross section of the upper portion of the ski pole taken along line 4—4 of FIG. 1.
Figure 5:
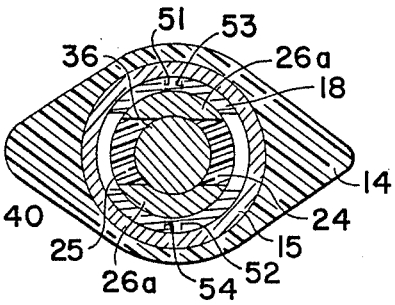
FIG. 5 is a cross section of the upper portion of the ski pole taken along line 5—5 of FIG. 1.
Figure 6:
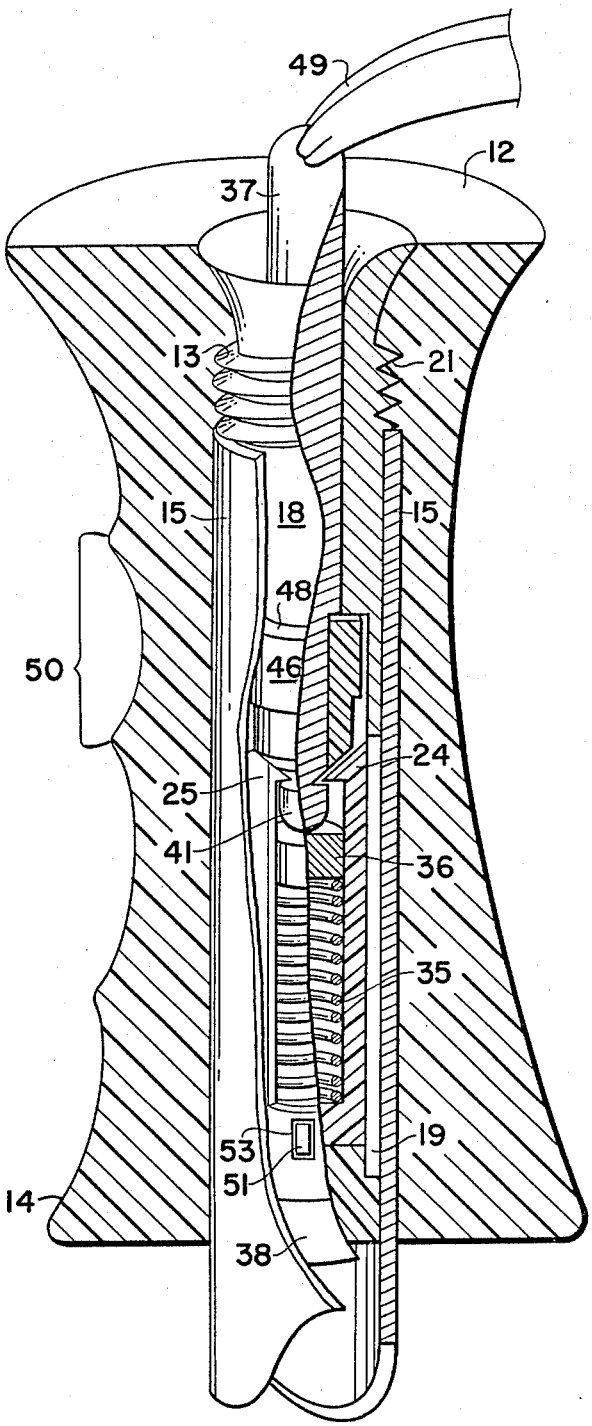
FIG. 6 is a perspective view of the upper portion of the ski pole with portions broken away to clearly illustrate the various components disposed within the upper end of the ski pole.

An important feature of the latches 24, 25 is the arcuate shape illustrated in FIGS. 4 and 5. This shape procides that the latch edges 33, 34 have greater curvilineal length and therefore greater holding power while maintaining the small clearances that provide for greater overall weight. Thus, latches 24 and 25 need only move laterally outward a short distance to release rod 37 yet still provide a strong positive locking action under normal conditions. In addition this arcuate shape also distributes the force over the latch edge 33 and 34 minimizing the wear and/or possibility of breakage.

The use of a helical spring 35 to bias the control rod 37 provides a reliable method of applying upward force. However, the spring 35 may tend to cause some rotational movement of the cylindrical member 26 via spring 35 moving against the bottom surface thereof. To fix the alignment of the latches 24, 25 with respective slots 23, 22, cylindrical member 26 is provided with two oppositely disposed ears or tabs 51, 52 that extend outwardly and fit within two oppositely disposed slots 53, 54 respectively cut through the wall of tubular member 18. The construction also provides for proper alignment of the various parts of the apparatus during assembly.

To prevent the dislodgment or removal of spring 35 during a release operation, spring disc 36 has a greater diameter than the diameter of end portion 41 of control rod 37 and greater than the aperture in collar 46 through which control rod 37 slidingly fits. Thus, even with latches 24, 25 moved outwardly to their maximum positions, disc 36 could not escape between the edges 33, 34.

Handle 11 has curved finger portions 50 for fitting the human hand to allow for a comfortable and secure grip of the ski pole 10. The upper portion 20 of tubular member 18 is flared outwardly defining a cone shaped space about the upper end 42 of control rod 37 to allow for adequate room to depress rod 37 when the user is wearing a heavy glove.

As is customary in ski poles 10, the lower end 17 of pole 16 will normally have a generally sharp pointed end and a snow basket located a few inches above the pointed end.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. In a ski pole having a hollow tubular upper end portion, a wrist strap, and a handle attached to said upper end portion, the improvement comprising selective connecting means for attaching said wrist strap to said ski pole, said connecting means including an elongated control rod having a lower end part and an upper end part extending above said handle and secured to said wrist strap, and positive locking means within said ski pole for releasably securing said rod to said ski pole, said control rod being movably engageable with the thumb of a hand of a skier to cause said locking means to release said rod for removal of said rod from said ski pole with said strap about a wrist of a skier, said positive locking means inhibiting any upward movement of said rod until unlocked by movement of said rod in a direction other than an upward direction of said rod.

2. In the ski pole as defined in claim 1 wherein said positive locking means comprises at least one resilient latch for releasably and laterally engaging said control rod, means for moving said latch laterally outward for releasing said control rod, said control rod engaging said means for moving in response to downward pressure on said rod to cause said latch to move laterally outwardly.

3. In the ski pole as defined in claim 2 wherein said latch has an upper surface, said means for moving said latch laterally outward comprises a slidingly movable tubular collar having an upper surface part and a lower surface part adapted to rest upon said upper surface of said latch, said control rod having a downwardly disposed shoulder resting upon said upper surface part of said collar for forcing said collar downwardly against said upper surface of said latch when said control rod is pushed downwardly, said collar causing said latch to move laterally for releasing said control rod.

4. In the ski pole as defined in claim 2 wherein said positive locking means includes a cylindrical member disposed below and connected to said latch and slidingly fitted within said pole against its interior wall thereof, and stop means for limiting the vertical movement of said latch.

5. In the ski pole as defined in claim 4 further comprising a tubular member affixed to said handle and having a shoulder, wherein said stop means includes a tubular collar resting upon said latch, said tubular collar having an upper surface vertically engaged by said shoulder of said tubular member to limit the upward movement thereof.

6. In the ski pole as defined in claim 2 further comprising a tubular member rigidly affixed to said handle and being disposed within said pole, said tubular member having a vertical slot, said slot being laterally aligned with said latch for permitting said latch to move outwardly thereinto when said control rod is forced downwardly.

7. In the ski pole as defined in claim 4 further comprising a tubular member rigidly affixed to said handle and disposed within said pole, said cylindrical member being disposed within said tubular member, said cylindrical member having at least one tab protruding laterally therefrom, said tubular member having at least one slot for nestingly receiving said tab when said cylindrical member is placed therein.

8. In the ski pole as defined in claim 1 further comprising biasing means for exerting upward force against said control rod.

9. In the ski pole as defined in claim 8 wherein said biasing means is a helical spring.

10. In the ski pole as defined in claim 6 wherein said handle has a lower end portion and an upper end portion including an interior threaded recess, said tubular member having a lower portion and an upper exterior threaded portion for threadedly engaging said recess, said handle being frictionally engageable about a hollow ski pole with said tubular member being disposed within the hollow ski pole.

11. In a ski pole as defined in claim 1 wherein said positive locking means comprises two spaced latches for releasably and laterally engaging said control rod, means for moving said latches laterally outward for releasing said control rod, said control rod engaging said means for moving in response to downward pressure on said rod to cause said latches to move laterally away from each other and laterally away from said rod.

12. In a ski pole as defined in claim 11 wherein further comprising a tubular member rigidly affixed to said handle and being disposed within said pole, said tubular member having two oppositely disposed vertical slots, said slots being laterally aligned with said latches for permitting said latches to move outwardly thereinto when said control rod is forced downwardly.

13. In a ski pole as defined in claim 11 wherein said control rod includes channel means in said lower end part selectively engagable with said latches to positively lock said control rod to said ski pole.

14. A ski pole comprising an elongated handle having a lower end portion and an upper end portion including an interior threaded recess, an elongated wrist strap detachably connected to said handle, an elongated cylindrical hollow pole having an upper portion and a lower portion, an elongated tubular member having a lower portion and an upper exterior threaded portion for threadably engaging said recess, said lower portion of said tubular member having at least one elongated vertical slot, said tubular member being slidingly disposed within said pole upper portion, said upper portion of said tubular member extending above said pole, a cylindrical member disposed within said tubular member and having at least one resilient latch, said latch having an upper end in latching position disposed inwardly, means to secure said cylindrical member within said tubular member with said resilient latch laterally aligned with said slot, an elongated cylindrical control rod having an upper end portion attached to said strap and a lower end portion, said lower end portion of said rod having a circumferential channel for releasable engagement by said latch, a tubular collar slidingly disposed within said tubular member and engageable with said latch, biasing means disposed within said tubular member to apply an upward force to said control rod, said latch being selectively released from said channel by applying downward pressure on said control rod causing said collar to force said latch into said slot for releasing said control rod and permitting said biasing means to move said control rod to dispose said channel thereof to be above said latch before said latch returns to its normal latching position.

15. A ski pole as defined in claim 14 wherein said control rod has an upper end portion and a lower end portion of smaller diameter than said upper end portion forming a downwardly disposed circular shoulder for engagement with said collar.

16. A ski pole as defined in claim 14 wherein said collar has a lower face for engaging said upper end of said latch.

17. A ski pole as defined in claim 14 wherein said cylindrical member has another resilient latch disposed oppositely to said latch, said tubular member having another vertical slot disposed oppositely to said vertical slot, said slots being laterally aligned with respective said latches for permitting said latches to move outwardly thereinto when said control rod is forced downwardly.

18. A ski pole as defined in claim 17 wherein said upper ends of said latches are formed with inwardly tapered faces, said collar having an inwardly tapered lower face for engagement with said upper face of said latches to provide laterally outward movement of said latches when said collar is forced downwardly.

19. A ski pole as in claim 14 wherein said means for securing said cylindrical member within said tubular member comprises a pair of spaced rectangular slots in said tubular member above the lower end thereof, a pair of spaced ears on said cylindrical member, said ears being positioned nestingly within respective said rectangular slots when said cylindrical member is placed therein.

20. A ski pole as defined in claim 14 wherein said biasing means is a helical spring.

* * * * *